US011278165B2

(12) United States Patent
Paveletzke et al.

(10) Patent No.: US 11,278,165 B2
(45) Date of Patent: Mar. 22, 2022

(54) SEWN STACK OF ABSORBENT SHEETS

(71) Applicant: Kimberly-Clark Worldwide, Inc., Neenah, WI (US)

(72) Inventors: Julie Ann Paveletzke, Appleton, WI (US); Christopher Peter Olson, Neenah, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 202 days.

(21) Appl. No.: 16/612,210

(22) PCT Filed: May 24, 2017

(86) PCT No.: PCT/US2017/034251
§ 371 (c)(1),
(2) Date: Nov. 8, 2019

(87) PCT Pub. No.: WO2018/217195
PCT Pub. Date: Nov. 29, 2018

(65) Prior Publication Data

US 2020/0196805 A1 Jun. 25, 2020

(51) Int. Cl.
*A47K 10/16* (2006.01)
*D21H 27/00* (2006.01)
(Continued)

(52) U.S. Cl.
CPC ..... *A47K 10/16* (2013.01); *D21H 27/002* (2013.01); *B31F 2201/0733* (2013.01);
(Continued)

(58) Field of Classification Search
CPC ..... D21H 27/30; D21H 27/002; D21H 21/22; D21H 27/005; D21H 27/007; D21H 27/02;
(Continued)

(56) References Cited

U.S. PATENT DOCUMENTS 1,170,498 A 2/1916 Klein
2,029,245 A 1/1936 Lyon
(Continued)

FOREIGN PATENT DOCUMENTS

CN 2167839 Y 6/1994
CN 201018959 Y 2/2008
(Continued)

OTHER PUBLICATIONS

ASTM D5650-97(2007) (Withdrawn Version)—Standard Test Method for Resistance to Bending of Paper of Low Bending Stiffness, ASTM. Retrieved from URL https://compass.astm.org/Standards/WITHDRAWN/D5650.htm on Mar. 12, 2019 (Year: 2007).
(Continued)

*Primary Examiner* — Jose A Fortuna
(74) *Attorney, Agent, or Firm* — Kimberly-Clark Worldwide, Inc.

(57) ABSTRACT

The invention relates to a stack of absorbent sheets, such as paper towels, toilet tissue, napkins, facial tissue and the like. The stack is sewn with a first line of stitching disposed adjacent to a first edge of the bound stack, such as the top edge. The stack further comprises a second line of stitches, which may be disposed adjacent to the first line of stitches. The second line of stitches comprises an unbalanced stitch to facilitate separation and removal of individual sheets.

19 Claims, 5 Drawing Sheets

(51) Int. Cl.
*D21H 27/02* (2006.01)
*D21H 27/30* (2006.01)
*D21H 21/22* (2006.01)

(52) U.S. Cl.
CPC ..... *B65H 2701/1924* (2013.01); *D21H 21/22* (2013.01); *D21H 27/02* (2013.01); *D21H 27/30* (2013.01)

(58) Field of Classification Search
CPC .. B42D 1/004; B42D 5/00; B32B 7/09; B32B 29/00; B65B 27/08; B31F 5/003; B31F 2201/0733; B65H 2701/1924
See application file for complete search history.

(56) References Cited

U.S. PATENT DOCUMENTS

| | | | | |
|---|---|---|---|---|
| 2,077,664 | A | 4/1937 | Beardsley | |
| 2,341,119 | A | 2/1944 | Rost | |
| 2,843,868 | A | 7/1958 | Borgstrom | |
| 3,716,132 | A | 2/1973 | Lewyckyj | |
| 3,778,324 | A | 12/1973 | Lavigne | |
| 4,007,950 | A | 2/1977 | Giulie | |
| 4,342,564 | A | 8/1982 | Lehmacher | |
| 4,662,005 | A | 5/1987 | Grier-Idris | |
| 4,715,758 | A | 12/1987 | Stobb | |
| 5,299,833 | A | 4/1994 | Madole | |
| 5,524,998 | A | 6/1996 | Schwartz | |
| 5,601,312 | A | 2/1997 | Funkhouser | |
| 5,656,132 | A * | 8/1997 | Farrington, Jr | B32B 29/00 162/117 |
| 6,263,814 | B1 | 7/2001 | Lawrence | |
| 6,536,185 | B2 | 3/2003 | Weder et al. | |
| 6,548,135 | B1 | 4/2003 | Hershey et al. | |
| 6,810,554 | B2 | 11/2004 | McKay | |
| 7,059,505 | B2 | 6/2006 | Tabor | |
| 7,449,085 | B2 | 11/2008 | Hermans et al. | |
| 7,661,715 | B2 | 2/2010 | Porat | |
| 7,789,430 | B2 | 9/2010 | Wittmeyer, Jr et al. | |
| 7,811,649 | B2 | 10/2010 | Post | |
| 8,834,984 | B2 | 9/2014 | Wildeman | |
| 10,611,541 | B2 * | 4/2020 | Dieringer | A47K 10/32 |
| 2003/0124935 | A1 | 7/2003 | Smith et al. | |
| 2004/0055521 | A1 | 3/2004 | Katou | |
| 2006/0068145 | A1 | 3/2006 | Chandaria | |
| 2007/0051484 | A1 * | 3/2007 | Hermans | D21H 21/22 162/109 |
| 2009/0148646 | A1 | 6/2009 | Bachmann et al. | |
| 2012/0217734 | A1 | 8/2012 | Edwards | |
| 2013/0077338 | A1 | 3/2013 | Wenzel et al. | |
| 2013/0127148 | A1 | 5/2013 | Cenzano et al. | |
| 2014/0058981 | A1 | 2/2014 | Mastromarco | |
| 2016/0090697 | A1 | 3/2016 | Hermans et al. | |
| 2016/0157647 | A1 | 6/2016 | Rampersad | |
| 2016/0355987 | A1 * | 12/2016 | Hermans | D21H 21/20 |
| 2018/0362236 | A1 * | 12/2018 | Dieringer | B65D 83/0805 |
| 2019/0092504 | A1 * | 3/2019 | Paveletzke | A47K 10/20 |
| 2020/0069120 | A1 * | 3/2020 | Paveletzke | B42D 1/004 |
| 2020/0196805 | A1 * | 6/2020 | Paveletzke | B65D 1/00 |
| 2020/0275809 | A1 * | 9/2020 | Paveletzke | B32B 27/08 |
| 2020/0290304 | A1 * | 9/2020 | Paveletzke | B32B 5/26 |

FOREIGN PATENT DOCUMENTS

| | | | | |
|---|---|---|---|---|
| CN | 101387049 | A | 3/2009 | |
| CN | 102131675 | A | 7/2011 | |
| CN | 103911844 | A | 7/2014 | |
| EP | 2210845 | A1 * | 7/2010 | B65H 45/28 |
| EP | 2210845 | B1 | 12/2011 | |
| GB | 190920248 | A | 1/1910 | |
| GB | 2578017 | A * | 4/2020 | D21H 27/002 |
| GB | 2578018 | A * | 4/2020 | B01J 20/24 |
| GB | 2581725 | A * | 8/2020 | B31F 5/003 |
| JP | 2002127640 | A | 5/2002 | |
| JP | 2006056542 | A | 3/2006 | |
| WO | WO-2014118688 | A2 * | 8/2014 | D21H 27/005 |
| WO | WO-2018217195 | A1 * | 11/2018 | D21H 27/002 |
| WO | WO-2018217197 | A1 * | 11/2018 | B42D 1/004 |
| WO | WO-2019088995 | A1 * | 5/2019 | B32B 7/04 |

OTHER PUBLICATIONS

TAPPI T494 (2006) Tensile Properties of Paper and Paperboard, TAPPI, Retrieved from URL http://www.tappi.org/content/sarg/t494.pdf on Mar. 12, 2019 (Year: 2006).

* cited by examiner

SEWN STACK OF ABSORBENT SHEETS

BACKGROUND OF THE INVENTION

Consumers want easy, convenient, and quick access to absorbent sheet products, such as paper towels, toilet tissue, napkins, facial tissue and the like for use in their home or work areas. Particularly, consumers want the products available where spills or messes occur, which are often in areas of the home where such products are traditionally kept, such as the kitchen or bathroom. When spills or messes occur in these areas consumers want quick and convenient access to absorbent sheets to clean up messes quickly to avoid damage to surfaces throughout the home. Therefore, there is a need for absorbent sheets, and particularly stacks of absorbent sheets, that may be easily located throughout the home and provide a convenient dispensing format to ensure easy, convenient and quick access to sheets where and when consumers need them.

Not only do consumers desire sheet formats that are easy and convenient to use, they also want formats that are aesthetically pleasing and compliment their home decor. Often to provide the ease and convenience consumer's desire, the sheet products are designed to be left in plain view in the home rather than stored away in cabinets. As such the products must be aesthetic pleasing and function as a home accessory.

Therefore, there is a need in the art for an absorbent sheet product that provides consumers with a convenient and easily accessible dispensing when and where the consumer needs such products. Furthermore, there is a need for a dispensing format that functions as a home accessory and compliments the consumer's home decor.

SUMMARY OF THE INVENTION

The present invention addresses the consumer's need for a convenient and easily accessible dispenser for absorbent sheets. The present stack is compact, sleek and the sewn binding compliments many consumer's home decor. Moreover, the stack may be mounted in a number of different places, providing the consumer with easy access to absorbent sheets throughout the home. For example, the stack may be laid flat on a horizontal surface, such as a countertop or table, or may be mounted to a vertical surface, such as a wall or cupboard using conventional and readily available mounting hardware such as adhesives or mechanical fasteners.

Absorbent sheets are provided in a stack that is sewn with a first line of stitching disposed adjacent to a first edge of the bound stack, such as the top edge. The stack further comprises a second line of stitches, which may be disposed adjacent to the first line of stitches. The second line of stitches comprises an unbalanced stitch to facilitate separation and removal of individual sheets. In this manner the first line of stitches binds and retains the sheets in the stack and the second line of stitches facilitates removal of the sheets from the stack. Because the second line of stitches provides a means of separating individual sheets from the stack individual sheets do not need to be provided with a line of perforations or weakness to separate individual sheets from the stack. This simplifies the manufacture of the stack.

To achieve an unbalanced second line of stitches the stitches may be formed from a first and a second thread where the threads have different properties. The different properties may be intrinsic to the threads themselves, such as specific work to rupture (SWR), relative work to rupture (RWR), relative tenacity (RT), relative extension (RE), stretch or extensibility, and elastic modulus. In other embodiments the unbalanced stitch may be the result of how the threads are sewn when forming the second line of stitches, such as the threads being sewn with different tensions.

Not only does the present stack of sheets satisfy many consumer needs, they may be rapidly manufactured at high rates of speed using conventional sewing equipment. For example, in one embodiment, the present stack of tissues may be manufactured using a double needle sewing apparatus where the two lines of stitching are sewn simultaneously, but with different characteristics so as to achieve a line of stitches that binds the sheets and another line of stitches that facilitates dispensing of individual sheets. The use of a double needle, where one tine binds the stack and the other forms a line of stitches that facilitates separation of individual sheets, results in a stack having first and second lines of stitches that are parallel to one another and disposed adjacent to a first edge of the stack.

In other embodiments the present invention provides a stack of absorbent sheets comprising a plurality of absorbent sheets having a machine direction and a cross-machine direction stacked in facing arrangement to form a stack of absorbent sheets, the stack having a top edge and a bottom edge; a binding element for binding the sheets together to form a stack disposed adjacent to the top edge of the stack, the binding element comprising a first line of stitches consisting of a plurality of spaced apart stitching holes and a pair of threads disposed between a first and a second stitching hole, the threads having substantially equal tension; and a second line of stitches consisting of a plurality of spaced apart stitching holes and a pair of threads disposed between a first and a second stitching hole, the threads having unequal tension.

In another embodiment the present invention provides a stack of absorbent sheet material comprising a plurality of absorbent sheets having a machine direction and a cross-machine direction stacked in facing arrangement to form a stack of absorbent sheets, the stack having a top edge and a bottom edge; a first line of stitches comprising a plurality of spaced apart stitching holes disposed adjacent to the top edge of the stack, a binding comprising a first and a second thread disposed between a first and a second stitching hole for binding the stack of sheets together, the threads having substantially equal tension; and a second line of stitches consisting of a plurality of spaced apart stitching holes and a pair of threads disposed between a first and a second stitching hole, the threads having unequal tension.

In still other embodiments the present invention provides a stack of absorbent sheet material comprising a plurality of absorbent sheets having a machine direction and a cross-machine direction stacked in facing arrangement to form a stack of absorbent sheets, the stack having a top edge and a bottom edge; a first line of stitches comprising a plurality of spaced apart stitching holes disposed adjacent to the top edge of the stack, a binding comprising a thread disposed between a first and a second stitching hole for binding the stack of sheets together; and a second line of stitches consisting of a plurality of spaced apart stitching holes and a pair of threads disposed between a first and a second stitching hole, the threads having unequal tension.

The first line of stitches for binding the stack of absorbent sheets can be carried out using one thread, two threads or three or more threads. Further, the stitching may be carried out by any means usually employed for the stitching of cloths such as single chain stitch, lockstitch or the like. In one embodiment the first line of stitches comprises a first thread belonging to a single chain stitch. In another embodiment the first line of stitches comprises two continuous threads crossing each other to be bound with each other so as to withstand the tensile force, wherein the stitch is formed by the lockstitch of the two threads.

DETAILED DESCRIPTION OF PARTICULAR EMBODIMENTS

Figure 1:
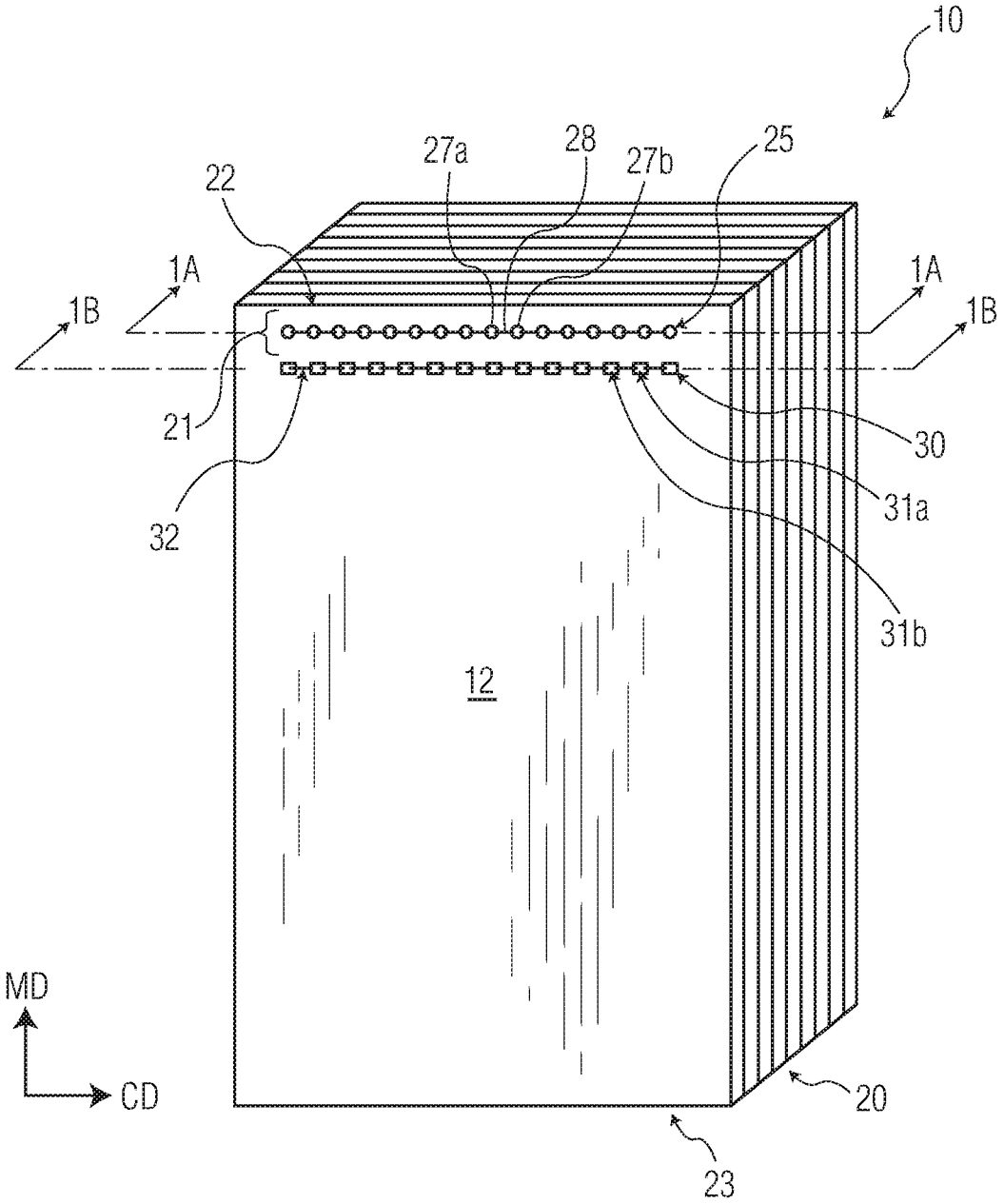
FIG. 1 is a perspective view of stack of absorbent sheets according to one embodiment of the present invention.

The invention relates to a stack of absorbent sheets, such as paper towels, toilet tissue, napkins, facial tissue and the like. The stack is sewn with a first line of stitching disposed adjacent to a first edge of the bound stack, such as the top edge. The stack further comprises a second line of stitches, which may be disposed adjacent to the first line of stitches. The second line of stitches comprises an unbalanced stitch to facilitate separation and removal of individual sheets. As used herein the term "unbalanced" generally refers to a stitch that is not properly formed and generally results from the threads forming the stitch having different tensions when sewn or from threads having at least one different intrinsic property such as specific work to rupture (SWR), relative work to rupture (RWR), relative tenacity (RT), relative extension (RE), stretch or extensibility, and elastic modulus.

The type of material used for the absorbent sheet should be understood to comprise any type of predominantly cellulosic material. However, the term "absorbent sheet" is not limited to paper products such as bath tissue and towels, but can also comprise absorbent nonwoven materials. These nonwoven materials can include synthetic fibers or blends of synthetic and cellulosic fibers with similar properties to those of wet laid tissue products formed from cellulosic fibers. In certain embodiments the absorbent sheets may comprise nonwoven airlaid sheets comprising synthetic fibers, binders, wet strength agents and the like. The sheets of material are stacked in facing arrangement and bound together by sewing and include perforations so as to facilitate removal of individual sheets from the stack. These and other embodiments will now be discussed in more detail with reference to the figures.

Generally, in one embodiment of the present invention, individual sheets within a stack are bound together by sewing the sheets together using thread. In this manner the stack comprises a first line of stitches that binds the sheets together and forms a binding element. The binding element binds the sheets together and maintains the integrity of the stack. In certain embodiments, the binding element consists essentially of stitches and is sufficiently strong to bind and retain the sheets such that the binding element is substantially free from any inter-sheet adhesive. As such, in a preferred embodiment, individual sheets within the stack are stacked in facing arrangement without an adhesive disposed there between. In still other embodiments, the stitches are sufficiently strong so as not to require any other form of mechanical attachment, such as clips, staples, grommets or the like.

In other embodiments, in addition to at least one line of stitches, the binding element may comprise a hot melt or pressure sensitive adhesive. In still other embodiments adjacent sheets may be bound to one another by thermal bonding, ultrasonic bonding, or chemical bonding. It is to be understood that the foregoing bindings are in addition to the at least one line of stitches that binds and retains individual sheets to form the stack. The supplemental bindings may be used to bind all of the sheets within a stack, only a portion of the sheets, or in some instances to bind a backing board or strip to the stack, as discussed in more detail below.

While supplemental bindings may be employed, in a preferred embodiment the binding element consists essentially of one or more lines of stitches. Thus, in a preferred embodiment, rather than employ an adhesive or the like to bind individual sheets together, the present invention uses at least one line of stitches, where the single line of stitches may employ one thread, two threads or three or more threads. Various stitches useful in binding the stack of absorbent sheets will be discussed in more detail below. The stitches may be construed using well known sewing techniques which typically employ a needle and thread to form a line of needle holes through which thread or yarn is threaded to bind the stack of sheet material.

Binding the stack by sewing typically results in the stack having at least one line of stitches comprising a continuous series of holes with thread disposed there between. For example, with reference to FIG. 1, the stack of absorbent sheet material 10 comprises a plurality of individual sheets 20 stacked in facing arrangement with one another. The stack 10 has a top edge 22 and a bottom edge 23. The stack is bound proximate to the top edge 22 by a first line of stitches 25. The first line of stitching 25 comprises a continuous line of spaced apart stitch holes 27*a*, 27*b* with a first thread 28 disposed there between. Generally the first line of stitching 25 is referred to as the binding and the area of the stack bound by the first line of stitching 25 is referred to herein as the bound or binding area 21, which as illustrated in FIG. 1 is proximate to the top edge 22 of the stack 10.

The sewing or stitching thread used to bind stacks of absorbent sheet material may comprise monofilament thread, or multi-filament thread. The thread weight may be based on the material properties of the sheets being bound, such as caliper, fiber compositions, tensile strength or the like. The thread weight may range from about 20 to about 120 weight. The thread may comprise a denier of from about 1 to about 2000 denier, such as from about 10 to about 1500 denier, and more preferably from about 100 to about 1000 denier and still more preferably from about 150 to about 500 denier.

The thread may comprise plied or twisted threads (e.g., z twist or s twist). The thread material may comprise a natural fiber, such as cotton, wool, silk, or other natural material, or may comprise a synthetic fiber such as polyester, nylon, polypropylene, rayon, or other synthetic material. The thread may comprise a continuous filament. The thread may comprise a monofilament. The thread may comprise a staple filament. The thread material may comprise a metal. The thread may comprise a wire, for example, a polymeric wire, or composite wire. The thread material preferably is biocompatible and, in some aspects, is resorbable. The thread material may comprise a polydioxanone, polycarbonate, polyurethane, poly(alpha-ester), polyglycolide, polylactide (e.g., poly(L-lactic acid), poly(D-lactic acid), and poly(D, L-lactic acid), poly (4-hydroxybutyric acid)—which is a homopolymer of 4-hydroxybutyrate (4HB), and belongs to a diverse class of materials called polyhydroxyalkanoates (PHAs)—and poly(lactide-co-glycolide)), polycaprolactone, polypropylene, polyester, poly(propylene fumarate), polyanhydride, polyacetal, polycarbonate (e.g., poly(trimethylene carbonate)), poly(ortho ester), polyphosphazene, polyphosphoester, polytetrafluoroethylene, polyethylene terephthalate, or any combination or co-polymer thereof. Polypropylene, polyester, and polyethylene are preferred, with monofilament polyethylene more preferred. In those embodiments where more than one thread is used to bind the stack, the threads preferably have similar properties.

The number of stitches per unit length, that is, the number of the surface thread parts of the first and/or the second stitching thread parts per unit length in each of the lines, can optionally be selected depending on the kind and the material of the absorbent sheets to be stacked and dispensed, the density and the thickness of the sheets or the resulting stack, the material and the diameter of the stitching thread, as well as the diameter of the stitching needle. Similarly the number of stitches per unit surface area, that is, the number of the surface thread parts of the first and/or the second stitching thread parts per unit surface area of the bound sheet, may be varied. For example, the number of stitches per unit length may range from about 10 to about 30 stitches per 10 cm, such as from about 15 to about 20 stitches per 10 cm. In certain embodiments the stitches may have a length from about 2.0 to about 8.0 mm, and more preferably from about 4.0 to about 6.0 mm. In other instances the bound area of the stack may range from about 20 to about 60 $cm^2$, such as from about 30 to about 40 $cm^2$ and the area may comprise from about 10 to about 40 stitches, such as from about 15 to about 25.

Figure 1A:
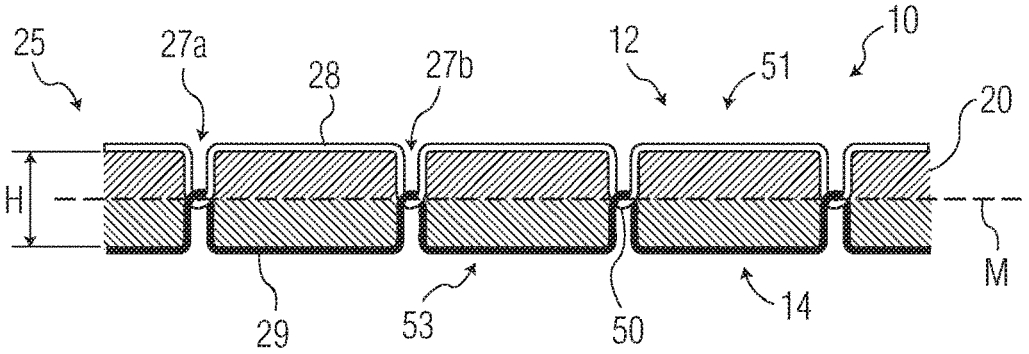
FIG. 1A is a cross-section through line 1A-1A of FIG. 1 illustrating a first line of stitches according to one embodiment of the present invention.

The sewn binding may be carried out using one thread, two threads or three or more threads. Further, the stitching may be carried out by any means usually employed for the stitching of cloths such as single lockstitch, chain stitch, loop stitch or the like. In a preferred embodiment, the stitching is carried out by a single line lockstitch. An exemplary line of lockstitches 25 is illustrated in FIG. 1A and generally comprises two separate threads—an upper thread 28 and lower thread 29—that are intertwined by the coordination of the sewing needle, which delivers the upper thread 28 into the stack of sheets 20 being sewn, and a secondary mechanism, typically a bobbin and bobbin driver, which provides the lower thread 29. The sewing needle forms the stitch holes 27*a*, 27*b* and threads the upper thread 28 therethrough. The coordinated movement of the sewing needle and bobbin driver intertwines the upper 28 and lower 29 threads to form the lockstitch 50.

In those embodiments where the binding comprises a lockstitch, the lockstitch may take any of the well-known geometries such as straight, zigzag, blind or the like. Formation of such geometries is well known in the art and may be controlled by the presence or absence of sideways movements of the machine's needle, and backwards movements of the machine's feed dogs.

In other embodiments the stack of absorbent sheets may be bound by a chain stitch or a loop stitch. Where the stack is bound using a loop stitch the method may also comprise a further step of securing adjacent stitching thread parts produced at the stitching step by means of binding or by adhesives so that at least one stitch formed by stitching may form an independent closed loop.

With reference again to FIG. 1A, the first line of stitching 25 may comprise a first and second thread 28, 29 sewn in a lockstitch pattern where the threads have substantially equal tension. In the illustrated embodiment, the first 28 and second threads 29 (also referred to as the top thread 28 and the bottom thread 29) cross one another at approximately the midpoint (M) of the z-direction height (H) of the stack to form a lockstitch 50. In this manner the first line of stitches comprises distinct stitches on the upper and lower surfaces of the stack of absorbent sheets. Further, by providing a first line of stitches where the tension of the top and bottom stitches is balanced the stitches appearing on the top and lower surfaces of the stack are substantially similar in appearance.

In other embodiments the first line of stitches may comprise a single thread sewn in using a balanced chain stitch. Chain stitches are well known in the art and may be sewn using a machine that loops a single length of thread back on itself using a looper. In such embodiments the balanced stitch results in a line of distinct stitches appearing on one surface of the sewn stack.

With reference again to FIG. 1 the sewn stack of absorbent sheets further comprises a second line of stitches 30. The second line of stitches 30, like the first line of stitches 25, generally comprises a plurality of spaced apart stitch holes 31*a*, 31*b* with thread 32 disposed there between. Unlike the first line of stitches 25, however, the second line of stitches 30 generally comprises a first and second thread 32, 33 (seen in detail in FIG. 1B) stitched together to form an unbalanced stitch. The unbalanced stitch may be achieved by using a first and second thread having at least one different intrinsic property or by applying different tensions to the threads during sewing.

Thus, in one embodiment, the second line of stitches comprises a first thread and a second thread wherein the first and second threads have different intrinsic properties. For example, if the second line of stitches comprises a lockstitch employing two threads the needle thread may comprise a first thread material having a first SWR, RWR, RT, RE, stretch or elastic modulus and the bobbin may comprise a second thread material having a second SWR, RWR, RT, RE, stretch or elastic modulus wherein the SWR, RWR, RT, RE, stretch or elastic modulus of the first and second thread materials is different.

In other embodiments the second line of stitches may be formed from two or more threads having similar intrinsic properties, but may be sewn such that the threads have different tensions when sewn into a stitch. For example, if the second line of stitches comprises a lockstitch employing two threads the needle thread may be provided with a first tension when sewing and the bobbin thread may be provided with a second tension when sewing, where the first and second tensions are different. When sewn in this manner the resulting stitch comprises a top and a bottom thread with different tensions and generally results in flat or running stitches appearing on the top of the sewn stack of sheets.

Figure 1B:
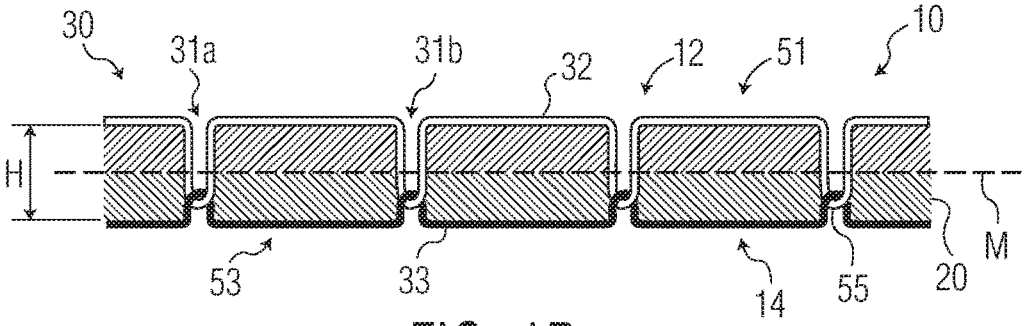
FIG. 1B is a cross-section through line 1B-1B of FIG. 1 illustrating a second line of stitches according to one embodiment of the present invention.

With reference now to FIG. 1B, a cross-sectional view of one type of second line of stitches is provided. In the illustrated embodiment the second line of stitches 30 comprises first and second threads 32, 33 (also referred to as the top thread 32 and the bottom thread 33) sewn in using a lockstitch. Because the bottom thread 33 has more tension that the top thread 32, the threads 32, 33 do not cross one another 55 at the midpoint (M) of the z-direction height (H) of the stack. Rather, the top thread 32 is pulled downwards by the bottom thread 33 resulting in a flat or running stitch along the bottom surface 14 of the stack 10.

Figure 2:
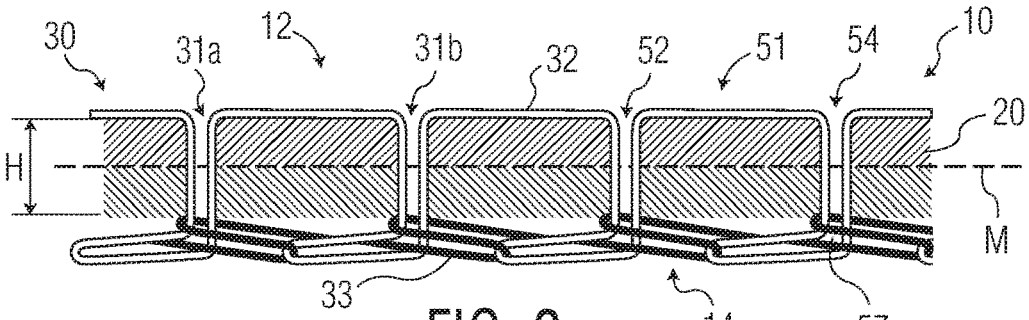
FIG. 2 is a cross-sectional view of an unbalanced double chain stitch useful in forming the second line of stitches according to one embodiment of the present invention.

An alternate second line of stitches is illustrated in FIG. 2. The second line of stitches 30 comprises a top thread 32 and a bottom thread 33, sewn using a double chain stitch. The top thread 32 forms distinct stitches 57 having distinct first and second ends 52, 54 along the top surface 12, but thread 32 displaced in the lateral direction along the bottom surface 14 of the stack 10 because the bobbin thread tension is too high or the needle thread tension too low.

Figure 3:
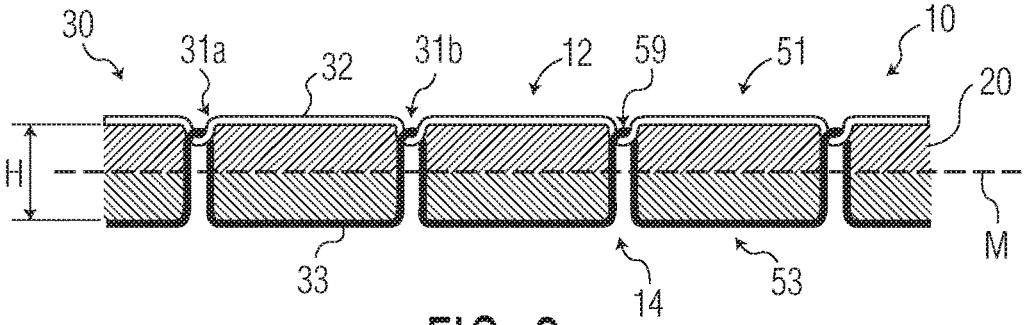
FIG. 3 is a cross-sectional view of an unbalanced lockstitch useful in forming the second line of stitches according to one embodiment of the present invention.

Still another embodiment of a second line of stitches is illustrated in FIG. 3. In the illustrated embodiment the second line of stitches 30 comprises first and second threads 32, 33 (also referred to as the top thread 32 and the bottom thread 33) sewn in using a lockstitch. The top thread 32 forms a flat or running stitch 51 along the top surface 12. Further, because the needle thread tension set too high or bobbin thread tension too low, the threads 32, 33 do not cross one another 59 at the midpoint (M) of the z-direction height (H) of the stack. Rather, the bottom thread 33 is pulled upwards by the top thread 32 resulting in a flat or running stitch 51 along the top surface 12 of the stack 10.

Figure 4:
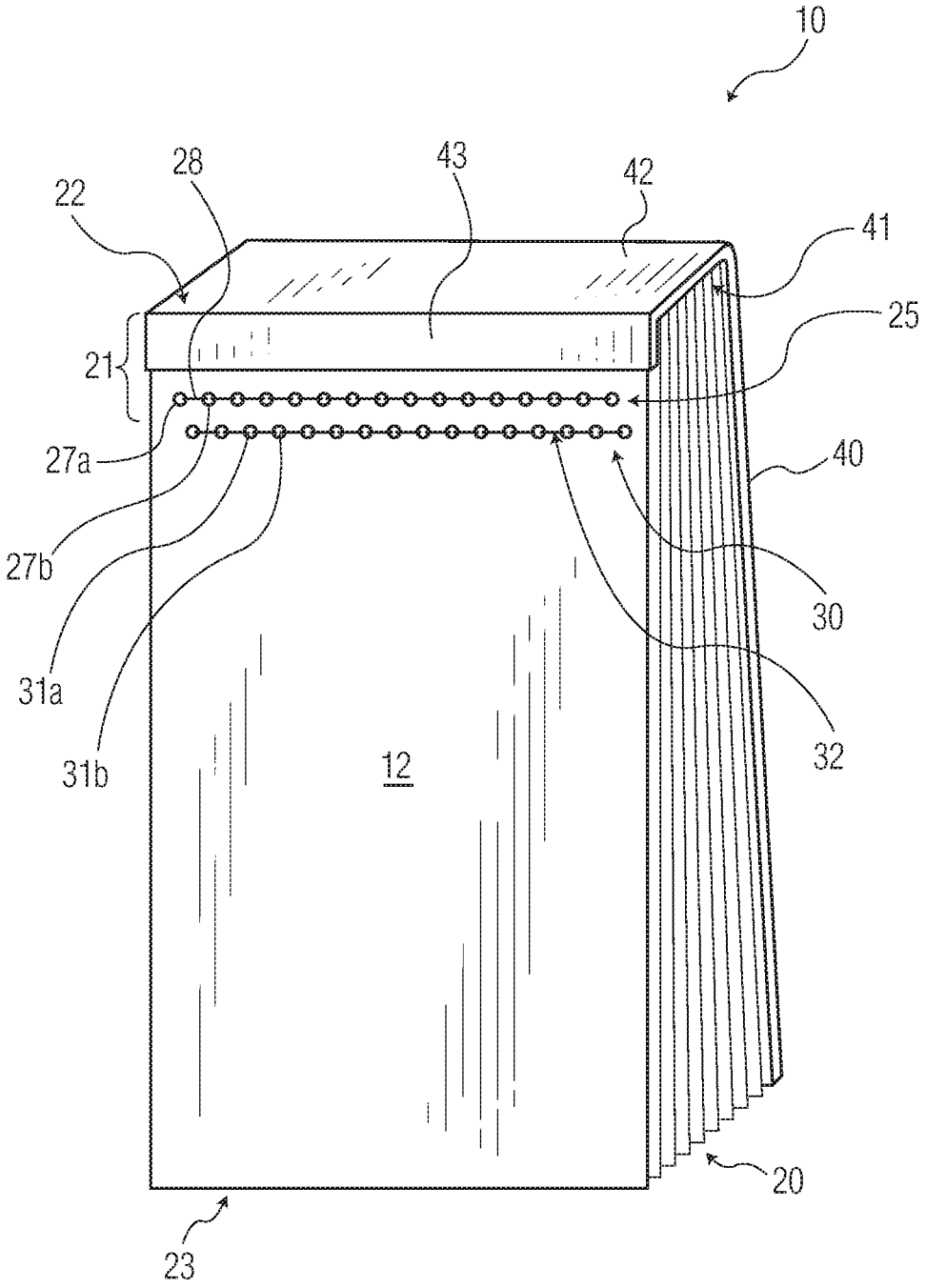
FIG. 4 is a perspective view of a stack of absorbent sheets according to another embodiment of the present invention.

With reference now to FIG. 4, in addition to the line of stitching 25 the stack 10 may further comprise a backing sheet 40 having a portion that is bent over the top edge 22 of the stack to form a top end 42 and facing 43. The backing sheet may be formed from a material having a stiffness greater than that of the absorbent sheets, such as cardboard or the like. The stiffness of a material may be measured using a Taber stiffness test described in ASTM standard D5650-97. As used herein Taber Stiffness and Taber Stiffness Units are generally reported as the MD measurement of a sample and are reported without reference to units. For example, the Taber Stiffness of the backing sheet or strip may be about 2 times greater, such as from about 2 to about 20 times greater, than the Taber Stiffness of the absorbent sheet material. In particularly preferred embodiments the backing sheet or strip and the absorbent sheet material not only differ in Taber Stiffness, but are formed from different materials. For example, in one embodiment the backing sheet or strip is formed from paperboard and has a machine-direction (MD) stiffness (measured as Taber Stiffness Units) greater than about 200 cm*gf and more preferably greater than about 250 cm*gf and the absorbent sheet is a cellulosic towel having a machine-direction (MD) stiffness (measured as Taber Stiffness Units) less than about 5.0 and more preferably less than about 3.0.

With continued reference to FIG. 4, the backing sheet 40 comprises a folded over portion 41 that extends around and over the top edge 22 to form a bound top edge 42 and a facing 43 that contacts the top most sheet 12 of the stack 10. In this manner the binding area 21 comprises both the line of stitches 25 and the folded over back sheet 40. As illustrated in FIG. 4 the line of stitches 25 are disposed such that the stitch holes 27*a*, 27*b* and thread 28 do not contact the folded over portion of the back sheet 40, however the invention is not so limited. In other embodiments the line of stitches may be disposed on the folded over portion. In still other embodiments the stitches are not disposed on the folded over portion, but extend through the back sheet.

While in certain embodiments it may be preferred to bind the sheets with stitching alone and not use other forms of attachment, such as adhesive or other means of mechanical attachment, in those embodiments where a backing sheet is folded over to partially envelop the sheets an adhesive may be provided between the folded over backing sheet or strip and the absorbent sheets. Alternately, a backing sheet may be provided, but not folded over the sheets so as to provide rigidity to the stack. In such embodiments the backing sheet may be adhesively attached to the bottom most sheet in the stack or may be bound along with the stack using stitching as described herein.

In still other embodiments the binding may comprise a strip rather than a back sheet. The strip generally does not extend along the back portion of the stack, but rather is disposed along the top edge and may be folded over to extend along a portion of the front of the stack.

In certain embodiments the backing sheet or strip may comprise a means for mounting the stack of absorbent sheets to a surface. In other embodiments a holder may be provided which may be made of metal, plastic or other suitable material and shaped to receive the bound edge of the stack to retain and hold the stack. The shape of the holder may be in the form of a flattened slotted tube or channel member open at least on one end to receive the bound edge of the stack. The holder may provide a means for fastening the holder to a vertical surface. When mounting the stack, the holder is fastened on a wall or the like and the pad is engaged therewith by inserting one end of the bound edge into the channel.

As discussed above, the first line of stitching comprises a continuous line of stitch holes with a thread disposed there between. Similarly, the second line of stitching is formed from a plurality of spaced stitch holes with a thread disposed there between. In certain embodiments the stitch holes forming the first and second line of stitches may be arranged pairwise. In still other embodiments not only are the stitching and perforations holes arranged pairwise, the two lines of holes are generally arranged parallel and adjacent to one another. In still other embodiments the first and second stitch holes are substantially vertically aligned with one another. For example, with reference to FIG. 1 the stitch holes 27 forming the first line of stitching 25 and the stitch holes 31 forming the second line of stitching 30 are arranged pairwise and are substantially vertically aligned with one another.

While the stitching holes and perforation holes may be aligned vertically, the invention is not so limited. In another embodiment, the stitch holes forming the first and second stitch lines are arranged pairwise, but are not vertically aligned. Thus, the stitching holes forming the first and second stitch lines may be vertically offset from one another, but still maintain a one-to-one numerical correspondence.

Figure 5:
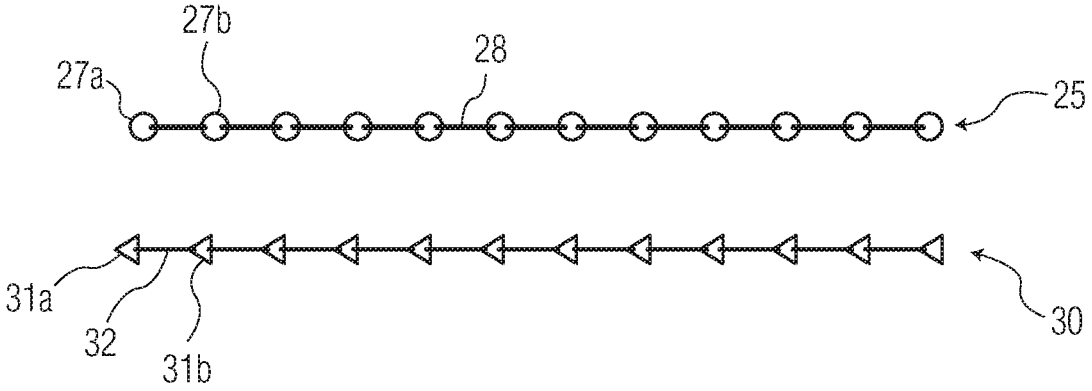
FIG. 5 is a detail view of one embodiment of a first and a second line of stitches useful in the present invention.
Figure 6:
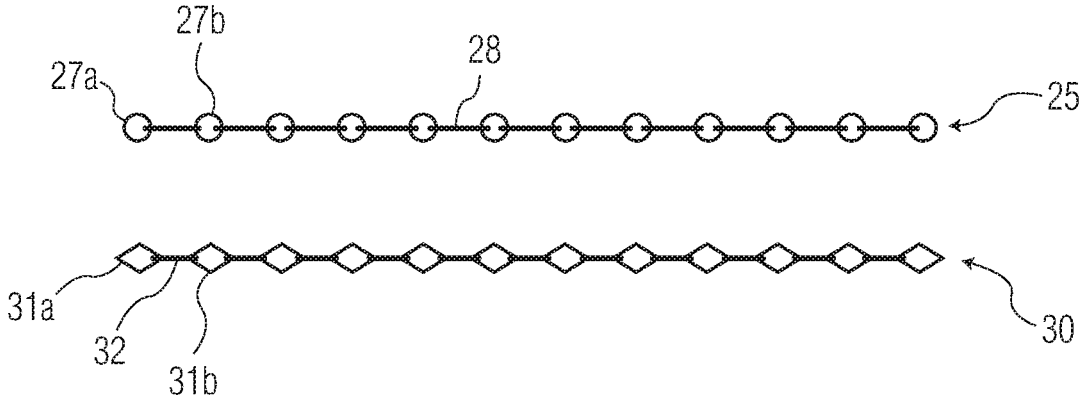
FIG. 6 is a detail view of an alternate embodiment of a first and a second line of stitches useful in the present invention.

While in certain embodiments it may be desirable to arrange the stitch holes forming the first and second line of stitches in a pair wise fashion, the size and shape of the holes need not be similar. Accordingly, in certain embodiments the stitching hole and the perforation hole have different shapes. In other embodiments the stitching hole and the perforation hole have different areas. For example, with reference to FIGS. 5 and 6, non-liming examples of stitching and perforation hole shapes and sizes are illustrated. For example, as illustrated in FIG. 5 the first line of stitching 25 may comprise stitch holes 27*a*, 27*b* that are circular and the second line of stitches 30 may comprise stitch holes 31*a*, 31*b* with thread 32 disposed there between where the holes 31*a*, 31*b* are triangle shaped. Alternatively, as illustrated in FIG. 6 For example, as illustrated in FIG. 5 the first line stitching 25 may comprises stitch holes 27*a*, 27*b* that are circular and the second line of stitches 30 may comprise the stitch holes 31*a*, 31*b* with thread 32 disposed there between where the holes 31*a*, 31*b* are diamond shaped.

In particularly preferred embodiments it may be preferred to form the stitch holes forming the second line of stitches from holes having a non-circular shape. For example, the second line of stitches may comprise oval shaped stitch holes, which may be orientated such that stresses are concentrated at one end when a user applies force to a sheet making it easier to initiate and propagate a tear along the holes. As a result, a lower force may be required to tear the perforation and separate a sheet from the stack. In addition to oval-shaped holes other suitable non-circular hole shapes may be used, for example triangular, diamond or square shaped holes, to produce stress concentrations and lower tearing force.

To achieve a pairwise arrangement of first and second lines of stitch holes, the stack of absorbent material may be manufactured using a sewing process that employs a double, triple or quadruple needle. Sewing machines having multiple needles are well known in the art. In one embodiment, the machine may comprise a double-needle chuck supporting a pair of spaced-apart needles arranged to form a double row of spaced apart holes. In the foregoing embodiment the needles may be in vertical alignment with one another, producing first and second lines of stitch holes that are similarly aligned, or they may be offset from one another. In other instances a unitary needle having two or more tines may be used where one tine is used to sew the first line of stitches and the other is used sew the second line of stitches.

In other embodiments additional weakened or perforated lines may be formed in each of the plurality of absorbent sheets to permit portions of each of the absorbent sheets to be removed from the stack. For example, additional perforated lines may be provided in each of the absorbent sheets to enable a user to remove only a portion of the sheet from the stack, such as a quarter or half of a sheet, while the remainder of the sheet remains bound to the stack.

The bound and perforated stack of absorbent sheets may be formed from a wide variety of absorbent sheet material. For example, the absorbent sheets have a basis weight (measured using TAPPI test method T-220) greater than about 10 grams per square meter (gsm), such as from about 10 to about 100 gsm and more preferably from about 15 to about 70 gsm and a caliper (measured in accordance with TAPPI test method T402 using an EMVECO 200-A Microgage automated micrometer (EMVECO, Inc., Newberg, Oreg.)) greater than about 200 μm, such as from about 200 to about 2000 μm. Further, the sheets may have a vertical absorbent capacity (measured as described in U.S. Pat. No. 7,449,085) greater than about 4.0 g/g, such as from about 4.0 to about 12 g/g and more preferably from about 6.0 to about 10 g/g.

In other embodiments the absorbent sheets have a dry geometric mean tensile strength (measured in accordance with TAPPI test method T-494 om-01) greater than about 500 g/3', and more preferably greater than about 750 g/3" and still more preferably greater than about 1,000 g/3", such as from about 500 to about 3,500 g/3" and more preferably from about 1,000 to about 2,500 g/3". In this manner the absorbent sheets have sufficient tensile strength to withstand the force necessary to detach individual sheets from the stack.

The absorbent sheet material may comprise one ply or more than one ply and may be folded or unfolded. In certain embodiments the individual sheets within the stack may be folded to form a folded sheet having multi-layers. Upon removal of an individual sheet from the stack it may be unfolded to yield a single absorbent sheet having a surface area greater than the surface area of the stack.

Accordingly, individual absorbent sheets within a stack, in an embodiment, may be in a folded configuration such as half-folds or quarter-folds of the sheets. For example, a sheet having a half-fold configuration may have four different edges, a first end and a second end, opposite the first end. A binding element is disposed along the first end and a line of perforations is disposed adjacent thereto to enable the sheets to be removed individually from the stack. Other folding configurations may also be useful herein, for example, Z-folds, or C-folds.

Further, it should be understood that the sheets and the resulting stack may take any number of different shapes and that while it may be desirable for two or more edges of sheets to be aligned with one another, the invention is not so limited. Additionally the size of individual sheets and the number of sheets in the stack corresponds to the number of usable units desired in the finished tissue product.

Figure 7:
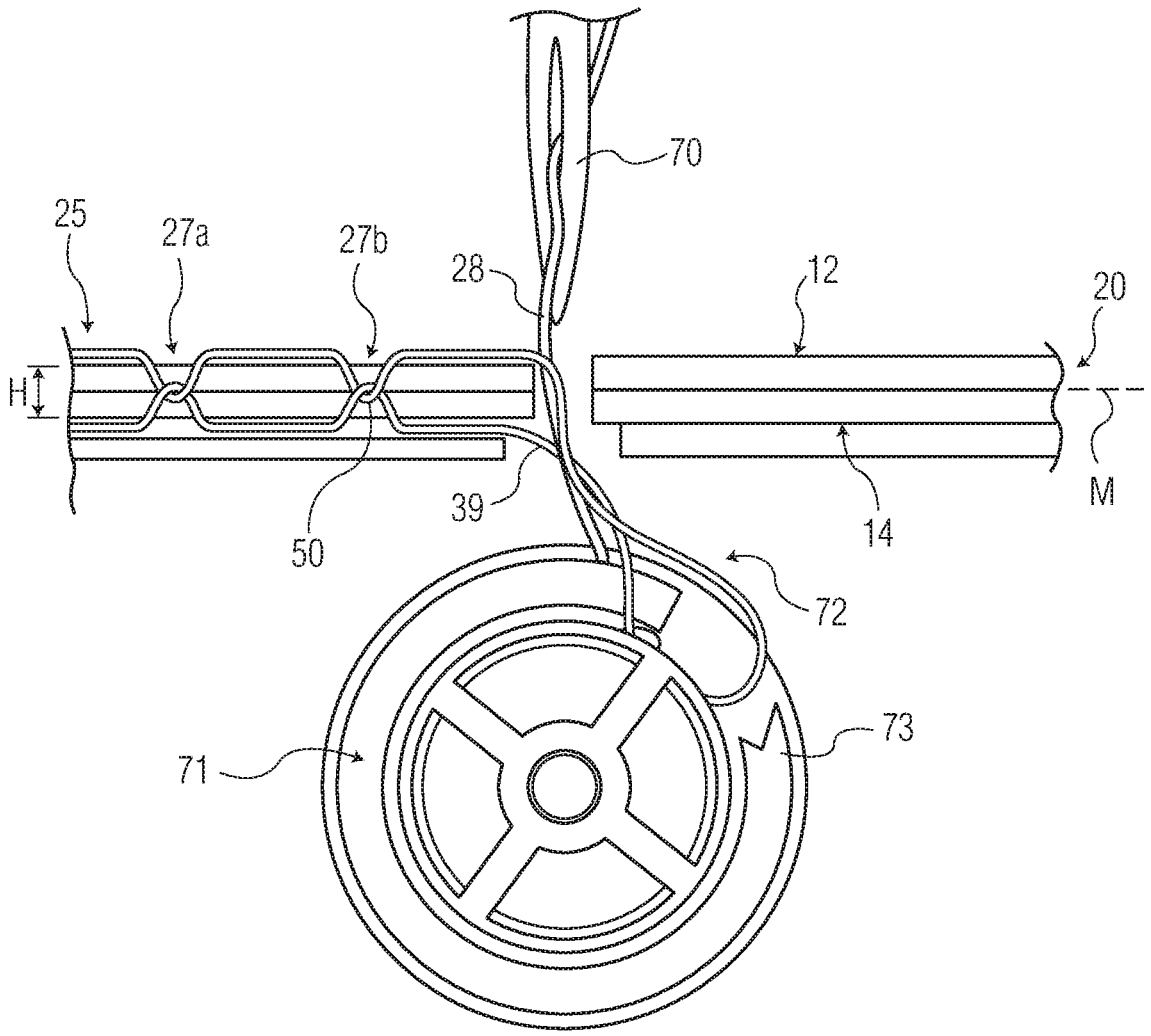
FIG. 7 illustrates one method of forming a first line of stitches according to one embodiment of the present invention.

To manufacture a bound and perforated stack of absorbent sheets according to the present invention, a plurality of sheets are cut to size and stacked in facing arrangement. In a particularly preferred embodiment the sheets are stacked in alignment with one another, that is that the machine directions of the sheets are aligned with one another and more preferably are aligned such that subsequent stitching is substantially perpendicular to the machine direction of the sheet. As illustrated in FIG. 7, a sewing needle 70 is provided with a first thread 28 and displaced in the vertical direction by a drive means. After engaging the thread 28 on the top end, the needle 70 is moved towards and through the stack of sheets 20, creating a stitching hole 27 and threading the thread through the hole. The shape and size of the stitch hole generally corresponds to the shape and size of the needle 70. As the needle 70 and top thread 28 are lowered through the stack 20 they enter the bobbin area 72, where a rotating hook 73 catches the top thread 28 at the point just after it goes through the needle 70. The hook mechanism 73 carries the top thread 28 entirely around the bobbin 71, so that it has made one wrap of the lower thread 29 (also referred to as the bobbin thread). Then the take-up arm (not illustrated) pulls the excess top thread (from the bobbin area) back towards the top surface, forming the lockstitch. The stack is then advanced one stitch length, and the cycle repeats. Care is taken to form a balanced lockstitch when forming the first line of stitches such that the top and bottom threads 28, 29 cross one another at a point 50 that is approximately at the midpoint (M) of the z-directional height (H) of the stack of absorbent sheets 20.

The second line of stitches may be formed in a similar manner as described above, however, the second line of stitches is formed from a stitch that is unbalanced. In the present embodiment the unbalanced second line of stitches may be formed by providing a first and a second thread having different tensions. The differing tension may arise from applying different tension to the first and second threads during the sewing process, such as by applying more tension to the needle thread relative to the bobbin thread or vise-a-versa. The resulting lockstitch is unbalanced such that the top and bottom threads do not cross one another at the midpoint (M) of the z-directional height (H) of the stack of absorbent sheets.

While the inventive stacks of absorbent sheets have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a stack of absorbent sheets comprising a plurality of absorbent sheets having a machine direction and a cross-machine direction stacked in facing arrangement to form a stack of absorbent sheets, the stack having a top edge and a bottom edge; a binding element disposed adjacent to the top edge of the stack, the binding element comprising a first line of stitches consisting of a plurality of spaced apart stitching holes and a thread disposed between a first and a second stitching hole; and a second line of stitching disposed adjacent to the binding element, the second line of stitching consisting of a plurality of spaced apart stitching holes and a first and a second thread disposed between a first and a second stitching hole wherein the first and second threads have different tensions.

In a second embodiment the present invention provides the stack of absorbent sheets of the first embodiment wherein absorbent sheets have a basis weight greater than about 10 grams per square meter (gsm), a geometric mean tensile strength (GMT) from about 500 to about 3,500 g/3" and a vertical absorbent capacity greater than about 4.0 g/g.

In a third embodiment the present invention provides the stack of absorbent sheets of the first or the second embodiments wherein the plurality of absorbent sheets comprises half-folded or quarter-folded absorbent sheets.

In a fourth embodiment the present invention provides the stack of absorbent sheets of any one of the first through the third embodiments wherein the first and second line of stitches comprise different stitch patterns.

In a fifth embodiment the present invention provides the stack of absorbent sheets of any one of the first through the fourth embodiments wherein the stitching holes of the first line of stitches have a first shape and the stitching holes of the second line of stitches have a second shape, wherein the first and second shapes are different.

In a sixth embodiment the present invention provides the stack of absorbent sheets of any one of the first through the fifth embodiments wherein the stitching holes of the first line of stitches have a round, semi-circular or oval shape and the stitching holes of the second line of stitches have a rectangular, square, diamond, or linear shape.

In a seventh embodiment the present invention provides the stack of absorbent sheets of any one of the first through the sixth embodiments wherein the first and second line of stitches are both substantially linear and arranged parallel to one another.

In an eighth embodiment the present invention provides the stack of absorbent sheets of any one of the first through the seventh embodiments further comprising a backing sheet or strip, wherein the backing sheet or strip has a Taber Stiffness greater than the plurality of absorbent sheets.

In a ninth embodiment the present invention provides the stack of absorbent sheets of any one of the first through the eighth embodiments further comprising a backing sheet or strip folded over the top edge of the stack of absorbent sheets to form a portion of the binding element.

In a tenth embodiment the present invention provides the stack of absorbent sheets of any one of the first through the ninth embodiments wherein the stack is substantially free from adhesive.

In an eleventh embodiment the present invention provides the stack of absorbent sheets of any one of the first through the tenth embodiments wherein the binding element further comprises a third line of stitches comprising a plurality of spaced apart stitching holes and a thread disposed between a first and a second stitching hole.

In a twelfth embodiment the present invention provides the stack of absorbent sheets of any one of the first through the eleventh embodiments further comprising a backing sheet or strip folded over the top edge of the stack of absorbent sheets to form a portion of the binding element.

What is claimed is:

1. A stack of absorbent sheets having a top surface and an opposed bottom surface, the stack comprising:

a. a plurality of absorbent sheets having a machine direction and a cross-machine direction stacked in facing arrangement to form a stack of absorbent sheets, the stack having a top edge and a bottom edge;

b. a binding element disposed adjacent to the top edge of the stack, the binding element comprising a first line of stitches comprising spaced apart first and second stitching holes and a thread disposed between the first and the second stitching holes; and c. a second line of stitching disposed adjacent to the binding element, the second line of stitching comprising spaced apart third and fourth stitching holes and a second and a third thread disposed between the third and fourth stitching holes wherein the second and third threads have different tensions wherein the stack is free from a line of perforations or weakness.

2. The stack of absorbent sheets of claim 1 wherein the first line of stitches comprises a chain stitch, a loop stitch, a lock stitch, an overlock stitch, or a lockstitch and the second line of stitches comprise a chain stitch or a lockstitch.

3. The stack of absorbent sheets of claim 1 wherein the first and second line of stitches comprise different stitch patterns.

4. The stack of absorbent sheets of claim 1 wherein the first and second line of stitches are lockstitches.

5. The stack of absorbent sheets of claim 1 wherein the second line of stitches are lockstitches and wherein the second thread has a higher tension than the third thread and a running stitch is disposed along the top surface of the stack.

6. The stack of absorbent sheets of claim 1 wherein the absorbent sheets have a basis weight greater than about 10 grams per square meter (gsm), a geometric mean tensile strength (GMT) from about 500 to about 3,500 g/3" and a vertical absorbent capacity greater than about 4.0 g/g.

7. The stack of absorbent sheets of claim 1 wherein the plurality of absorbent sheets comprises half-folded or quarter-folded absorbent sheets.

8. The stack of absorbent sheets of claim 1 wherein the first and second stitching holes have a first shape and the third and fourth stitching holes have a second shape, wherein the first and second shapes are different.

9. The stack of absorbent sheets of claim 1 wherein the first and second stitching holes have a round, semi-circular or oval shape and the third and fourth stitching holes have a rectangular, square, diamond, or linear shape.

10. The stack of absorbent sheets of claim 1 further comprising a backing sheet or strip, wherein the backing sheet or strip has a stiffness greater than the plurality of absorbent sheets.

11. A stack of absorbent sheets having a top surface and an opposed bottom surface, a top edge and an opposed bottom edge, a z-directional height and a z-directional midpoint, the stack comprising:

a. a plurality of absorbent sheets stacked in facing arrangement;

b. a first line of stitches comprising spaced apart first and second stitching holes and a thread disposed between the first and the second stitching hole; and c. a second line of stitching disposed adjacent to the binding element, the second line of stitching comprising spaced apart third and fourth stitching holes a second and a third thread disposed between the third and fourth stitching holes wherein the second and third threads are disposed in a lockstitch pattern and intersect one another in the third and fourth stitching holes and wherein the point of intersection is above the z-directional midpoint of the stack wherein the stack is free from a line of perforations or weakness.

12. The stack of absorbent sheets of claim 11 wherein the first line of stitches comprises a chain stitch, a loop stitch, a lock stitch, an overlock stitch, or a lockstitch.

13. The stack of absorbent sheets of claim 11 wherein the second thread has a higher tension than the third thread and wherein the second and third threads intersect one another above the z-directional midpoint of the stack and a running stitch is disposed along the top surface of the stack.

14. The stack of absorbent sheets of claim 11 wherein absorbent sheets have a basis weight greater than about 10 grams per square meter (gsm), a geometric mean tensile strength (GMT) from about 500 to about 3,500 g/3" and a vertical absorbent capacity greater than about 4.0 g/g.

15. The stack of absorbent sheets of claim 11 wherein the plurality of absorbent sheets comprises half-folded or quarter-folded absorbent sheets.

16. The stack of absorbent sheets of claim 11 wherein the first and second stitching holes have a first shape and the third and fourth stitching holes have a second shape, wherein the first and second shapes are different.

17. The stack of absorbent sheets of claim 11 wherein the first and second stitching holes have a round, semi-circular or oval shape and the third and fourth stitching holes have a rectangular, square, diamond, or linear shape.

18. The stack of absorbent sheets of claim 11 wherein the first and second lines of stitches are both substantially linear and arranged parallel to one another.

19. The stack of absorbent sheets of claim 11 further comprising a backing sheet or strip, wherein the backing sheet or strip has a Taber Stiffness greater than the plurality of absorbent sheets.

* * * * *